US012410000B2

(12) United States Patent
Lewis

(10) Patent No.: US 12,410,000 B2
(45) Date of Patent: Sep. 9, 2025

(54) DRIP-PREVENTING BEVERAGE SLEEVE FOR PAPER CUPS

(71) Applicant: Michael R. Lewis, West Hills, CA (US)

(72) Inventor: Michael R. Lewis, West Hills, CA (US)

(73) Assignee: Michael R. Lewis, West Hills, CA (US)

( * ) Notice: Subject to any disclaimer, the term of this patent is extended or adjusted under 35 U.S.C. 154(b) by 49 days.

(21) Appl. No.: 18/538,677

(22) Filed: Dec. 13, 2023

(65) Prior Publication Data

US 2025/0197087 A1 Jun. 19, 2025

(51) Int. Cl.
*B65D 81/38* (2006.01)

(52) U.S. Cl.
CPC ..... *B65D 81/3876* (2013.01)

(58) Field of Classification Search
CPC ..... B65D 81/3876; B65D 81/3886; B65D 81/3865; B65D 81/3881; B65D 81/3874; B65D 81/3869; B65D 25/36; A47G 23/0216; A47G 2023/0291
USPC ..... 220/739, 738, 903, 737, 703, 592.16
See application file for complete search history.

(56) References Cited

U.S. PATENT DOCUMENTS

2005/0121457 A1* 6/2005 Wilson ..... A47G 23/0216 220/739
2007/0215626 A1* 9/2007 Wright ..... B65D 3/22 220/737
2009/0302047 A1* 12/2009 Anderson ..... B65D 81/3879 220/739
2012/0285974 A1* 11/2012 Hanel ..... B65D 81/3876 220/739

* cited by examiner

*Primary Examiner* — King M Chu

(57) ABSTRACT

A beverage cup-sleeve designed for the retail beverage industry is disclosed herein. The cup-sleeve consists of two key components, a sleeve, and an absorbent liner, securely adhered together. Unlike conventional hot beverage sleeves, this innovative design situates the sleeve at the top of the cup, precisely where it meets the rolled-lip, positioning it just beneath the lid's ridge. With the lid in place, the integrated absorbent liner and cup-sleeve combination effectively prevent drips by containing potential leakage resulting from the normal manufacturing imperfections in the paper beverage cup, specifically at the seam and rolled-lip. This containment mechanism proves especially crucial when the beverage is hot. Once the sleeve-liner combination is slipped onto the cup and positioned at the rolled-lip, it ensures the effective containment of potential leakage, thereby preventing drips and minimizing any undesired soiling of the beverage holder's hand and surroundings.

7 Claims, 6 Drawing Sheets

DRIP-PREVENTING BEVERAGE SLEEVE FOR PAPER CUPS

BACKGROUND

The present invention is in the technical field of beverage sleeves. More particularly the invention is in the field of beverage sleeves which provide thermal insulation. More particularly the invention is in the field of beverage sleeves which prevents drips.

For many decades people have been frequenting coffee shops, gas stations, take-out restaurants and the like to obtain beverages to take "on the go." With the rise of coffee shops, the coffee-culture has become more popular and have become more than just sit down restaurants, they are "take-out" coffee shops dispensing hot and cold beverages for people everywhere.

During the rise of the coffee culture, many inventions as well as accommodations have been made to try and eliminate the inconveniences caused by hot beverages which include heat discomfort and leakage which leads to soiling hands, clothes and the surroundings.

Interestingly, most large chain coffee houses are aware of the said leaking problem leading to drips and soiling, so much so that they try to accommodate this by rotating the lid in such a way that the seam of the cup is positioned directly opposite of the sipping area. This accommodation does not solve the problem nor does it make a large impact on minimizing the leaks and drips.

Thus, a hot beverage cup sleeve solving the aforementioned problems is desired.

SUMMARY OF INVENTION

Therefore, the present invention is a beverage sleeve which insulates the cup, prevents thermal transfer to the drinker and contains leakage of the contents through the space between the lid and paper cup, hence preventing drips.

This improved design of the classic beverage sleeve is essentially made up of two (2) main parts, not including the adhesive. The essential components are a sleeve and an absorbent material which lines the inside of the sleeve. The sleeve with its attached absorbent material together is referred to as sleeve-liner for the purposes of this paper. Individually, each is known as the "sleeve" and "absorbent liner" respectively.

The outer sleeve is made, but not limited to, a relatively thin corrugated cardboard, non-corrugated cardboard, heavy craft paper or other stiff, but malleable material to allow stability, stacking, good grip, ample space for advertising, and durability. It should be made of materials standard in the sleeve making process that is widely used today.

Prior to assembly, there is a first end, a second end, a first-cup opening, a second cup opening, and an adhesive holding the first and second ends together forming a wrap. This is sized to fit snugly around tapered paper beverage cups positioned at the cup's highest point-butted against the rolled-lip. The sleeve is wrapped circumferentially around the cup like most beverage sleeves, however, instead of being placed midway down the cup, this sleeve-liner is positioned higher up on the cup just beneath the rolled edge, referred to as "lip" or "rolled-lip" of tapered paper cups.

The absorbent material is affixed to the inside of the sleeve, matching the shape of the sleeve, using a non-toxic food-safe adhesive or a classically accepted adhesive used in this type of food service. The absorbent liner may be an absorbent material similar to an inexpensive napkin or paper towel-type paper. Due to the absorbent liners placement on the sleeve, it should be imperceptible from the sleeve side once placed on the cup.

The sleeve-liner is designed to fit just beneath the lid. As previously mentioned, leakage typically occurs when the lid is attached to rolled-lip where it meets the seam. As the seam is exposed to fluid for short periods of time, leakage occurs and seeps directly into the liner on the back (cup side) of the sleeve. The fluid will then wick around the inside of the sleeve into the absorbent liner. The sleeve-liner protects the hand and other vulnerable surroundings (clothing, car upholstery, etc.) from being soiled by the cup's contents caused by leaking and dripping.

For the purposes of this invention, the sleeve should not be used alone nor should it be made of solely the absorbent material. This is because as the liquid is absorbed into a single-liner made solely of absorptive material, the liquid will not only saturate the sleeve, but continuously soil the hands and likely not hold its form. This invention calls for a sleeve to be used in conjunction with the absorptive liner adhered together as one piece, the sleeve-liner, and placed at the cup's highest position.

In addition, the sleeve-liner, due to its two (2) essential parts (the sleeve and absorbent liner), will likely decrease dissipation of heat more than standard sleeves thus providing better insulation properties and further protect the beverage holder from thermal discomfort.

BRIEF DESCRIPTION OF THE DRAWINGS

FIG. 8*a*—Exploded view of cup's rolled lip and seam showing site of leakage

DETAILED DESCRIPTION

Figure 1:
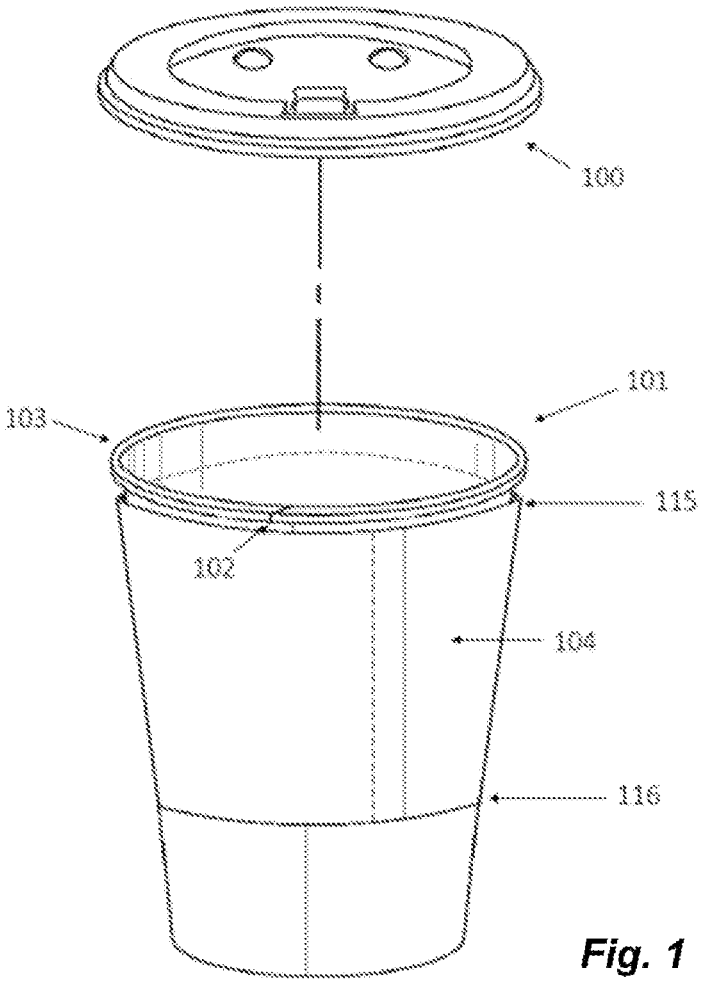
FIG. 1—Elevation view of Sleeve-liner on standard use tapered paper cup

Referring now to the invention in more detail, FIG. 1 shows a standard tapered paper cup 101 with generic lid 100 and an assembled sleeve-liner 104, according to an embodiment of the invention. The cup 101 has two major parts worth mentioning for purposes of this invention. The first is the rolled-lip 103 and the seam 102 created by the manufacturing process of paper cups. These two parts are important because they are the major problem in the leaking and dripping problem herein.

Figures 2, 2A:
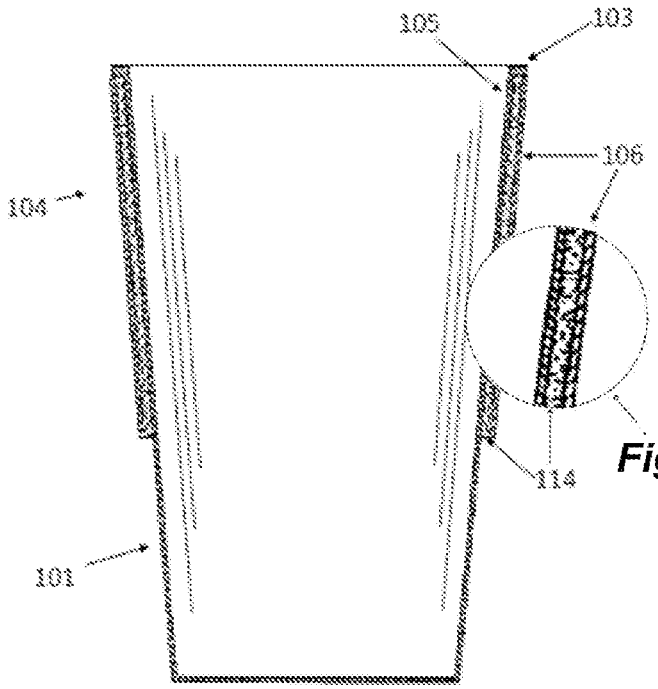
FIG. 2—Cross section of cup with sleeve-liner attached
FIG. 2*a*—Exploded view of the cross section of sleeve-liner
Figures 3, 3A:
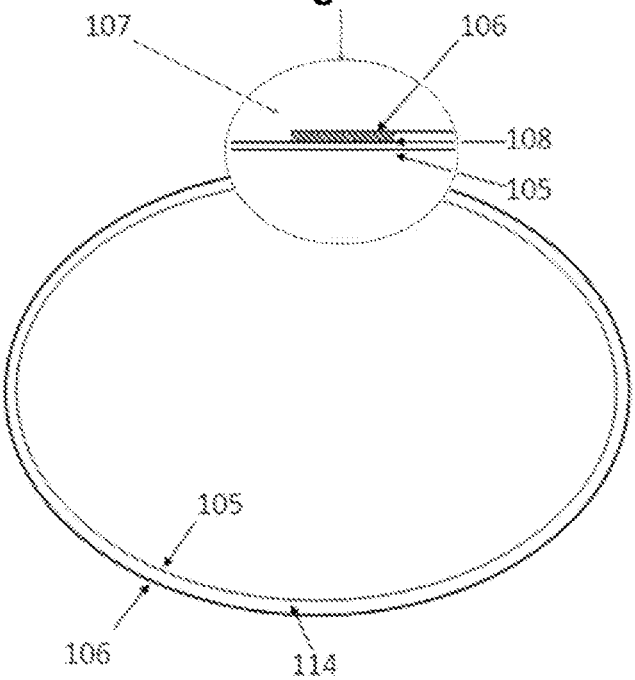
FIG. 3—Top view of sleeve-liner
FIG. 3*a*—Exploded view of the Sleeve-liner overlap
Figure 8:
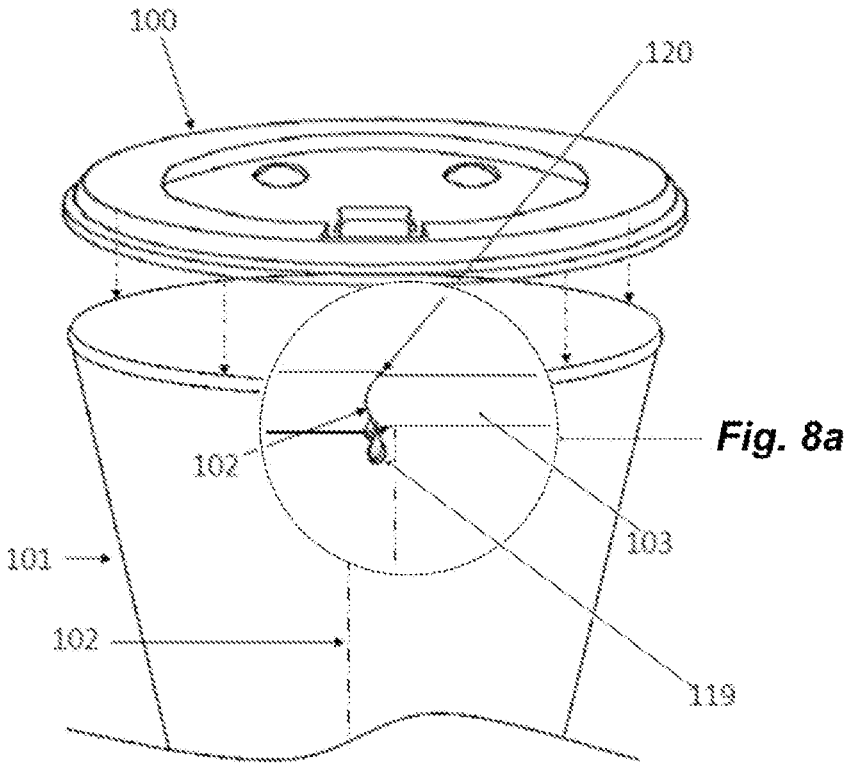
FIG. 8—Perspective view of cup

In more detail, referring to one embodiment of the invention in FIG. 1, FIG. 2 and FIG. 8, sleeve-liner 104 is circumferentially attached to the provided tapered paper cup 101 by sliding the cup through the first-cup opening 115 and then through 116. The sleeve-liner is comprised of two sides, the absorbent liner 105 which faces the cup 101 and the sleeve 106 which faces outwardly. The use of a sleeve is not novel, but it is typical of most sleeves for tapered paper cups 101. Due to the semi-conical shape of the cup, providing the tapered shape, the second opening 116 will prevent the cup 101 from falling through the sleeve-liner 104. Unlike most sleeves made for cups which are usually placed at or near the center of the cups this sleeve-liner 104 is slid into place at the top of the cup 101 where it meets the rolled-lip 103. The lid 100 will still be able to attach normally as per its defined usage. The sleeve-liner 104 will not interfere with its function. As stated previously, the leakage causing drips 119 occurs at the seam 102 where it meets the lid 100 due to hot contents causing heat expansion and contraction at the seam 102 where a slight height discrepancy 120 exists, which was caused by the manufacturing process. The leakage is then captured by the sleeve-liner 104 and wicked within the absorbent liner 105 thus preventing drips and soiling of hands and other vulnerable objects.

In further detail still referring to one embodiment of the invention in FIG. 1 and including another embodiment of the invention, FIG. 2, FIG. 2*a*, FIG. 3, FIG. 4 and FIG. 7, the sleeve-liner may be of typical/classic sleeve height 112 equal but not limited to that of 2 to 4 inches high. However, the circumference of the first-cup opening 115 will not be standard when compared to prior sleeves, because the sleeve-liner 104 will sit higher up on the tapered paper cup 101—remember the cup is tapered so it has variable diameters from the top of the cup to the bottom. Because all paper cups are not of the same exact size, the sleeve-liner 104 comprising the first and second cup opening 115 and 116 will need to be of a specific circumference as denoted by width of sleeve-liner top 113 and width of sleeve-liner bottom 118 to fit the slight variations in manufactured tapered paper cups 101. The process for forming sleeves has been discussed multiple times in past inventions and specifically in exemplary detail in U.S. Pat. No. 8,251,277 to Katchko et al. and is beyond the scope of this invention, therefore will not be discussed further. Once the sleeve-liner 104 is slid into its proper place on the tapered paper cup 101 there is no adjustment needed. The absorbent liner 105 on the backside of the sleeve 106 is circumferential and therefore any position is in contact with the leak site at the seam 102. It is not seen when in place.

Figure 4:
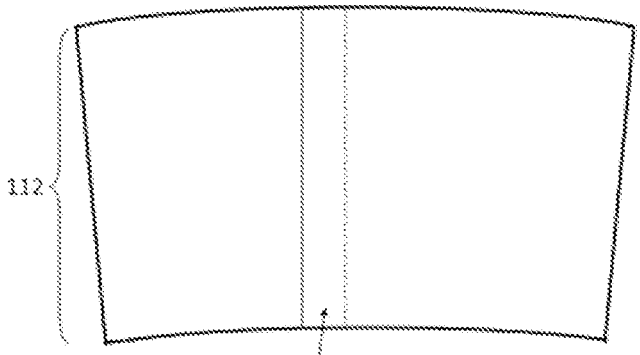
FIG. 4—Side view of sleeve-liner showing closure
Figure 5:
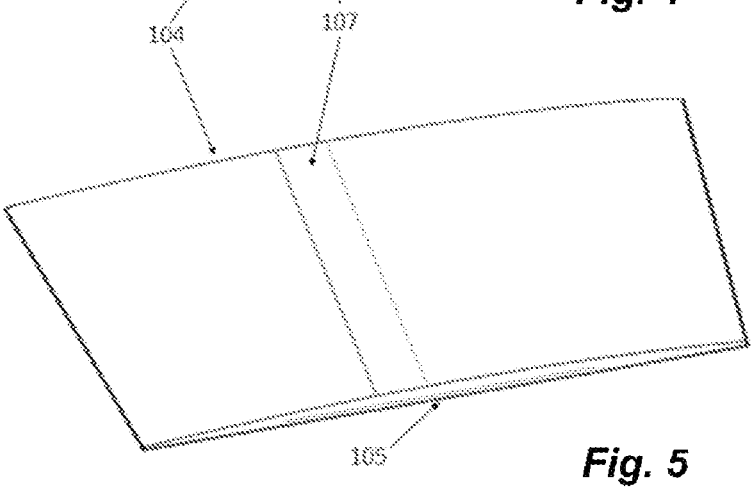
FIG. 5—Perspective view of collapsed sleeve-liner showing closure
Figure 6:
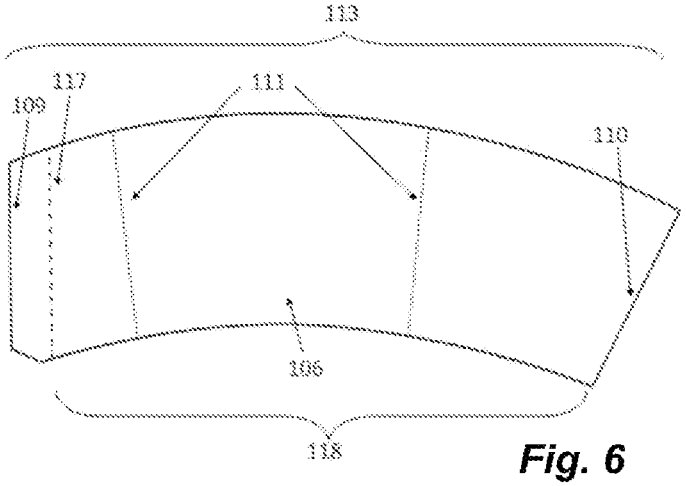
FIG. 6—Unassembled view of sleeve-liner (outside view)
Figure 7:
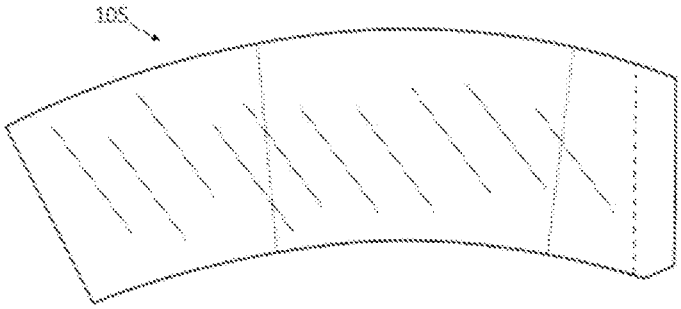
FIG. 7—Unassembled view of sleeve-liner (inside view)

In one embodiment of this invention, the construction details as shown in FIG. 3, FIG. 4, FIG. 5 and FIG. 6 references the sleeve-liner individually as well as its individual parts. The absorbent liner 105 and sleeve 106 are held together by sleeve-to-liner adhesive 114 which would be made of a standard, preferably non-toxic food-safe adhesive and likely the same adhesive as 108 which hold the sleeve-liner overlap 107, as seen in FIG. 4*a*, in place similar to what is being used on conventional sleeves today. FIG. 4 and FIG. 5 show this overlap in broader detail.

In another embodiment of the invention, due to variations in adhesive properties, different adhesives may be needed or used. Further, the sleeve-to-liner adhesive may be of different quality, strength and chemical properties from adhesive 108. The choice of the sleeve-to-liner adhesive 114 would be best suited to not interfere with the absorption of fluid into the absorbent liner 105. The sleeve 106 would be made of but not limited to a thin but durable corrugated cardboard, non-corrugated cardboard or standard sleeve material used on conventional sleeves today which would accept conventional printing and advertising practices. The absorbent liner 105 should be shaped, cut or die cut to match that of the sleeve 105. It should be made of but not limited to an absorbent material making up the family of papers of napkins, paper towels or other recyclable, inexpensive absorbent materials. The sleeve-liner 104 will have an overlap as conventional sleeves do, which is the sleeve-liner overlap 107. This part may be held in place by the same adhesive as the sleeve-to-liner adhesive 114. However, in an effort to minimize multiple adhesives in this product, conventional sleeve closure adhesives used on current similar sleeves would be the first choice.

In another embodiment of the invention and in more detail referencing FIG. 1, FIG. 3, FIG. 4, FIG. 6 and FIG. 7 shows the sleeve 106 and the absorbent liner 105 separate because they are two (2) different entities. When adhered, folded and put together at the sleeve-liner overlap 107 by adhesive 108 it becomes the sleeve-liner 104. The sleeve 106 will have fold lines 111 which may or not be in a perforated form. The absorbent liner 105 once cut, is placed in the sleeve 106 and held together by the sleeve-to-liner adhesive 114 by the most efficient, food-safe and economical production method. The first end 109 is the likely side which has adhesive applied while the second end 110 is overlapped to a distance of a relatively small measurement, not to exceed the distance of the second-end stopping point 117. One should note that the basic production of sleeves on the market today is well thought out and this is not an attempt to rework or "reinvent the wheel." The major difference between this invention and other sleeves is the addition of an absorbent liner 105 adhered to the sleeve 106 and having the width of the sleeve-liner top 113 and sleeve-liner bottom 118 match that to the circumference of the customers cups so that the first-cup opening abuts the cup's rolled-lip 103 and the second cup opening 116 fits snug around the cup at a distance defined by the height of sleeve-liner 112.

Lastly referring to the sleeve-liner, 104 if a retailer so prefers, advertisement or other printing can be placed on this surface.

The advantages of the present invention include, without limitation, that it is similar in shape and basic use to that of most sleeves for hot beverages on the market today and therefore requires the same skill to apply as well as not requiring major changes in the way sleeves are produced.

In this embodiment of the invention, this sleeve-liner improves upon what is already available on the market, as it prevents drips from the cup by containing the leak, which causes soiling of hands and surroundings. The area of leakage is effectively unseen and therefore the drips are contained between the rolled-lip, the lid and the sleeve-liner. When the absorbent liner is dampened from leaky fluid, it will continue to wick away the fluid circumferentially away from the seam preventing drips until the material reaches its saturation point. The saturation point is rarely reached due to the amount of fluid needed to reach it.

This invention will allow for high volume, easy stacking for shipment, storage and display. Further, it will allow for advertisement or printing on the outside of the sleeve itself. Additionally, because the height of the sleeve-liner may be increased greater than that of current sleeves, more surface area for printing can be accommodated. What's more, this increase in surface area may also provide additional thermal insulation compared to conventional sleeves, thus preventing excessive heat dissipation from the cup.

By virtue of the foregoing, this is an improved sleeve-liner that overcomes various drawbacks of prior sleeves and collars meant to protect and prevent drips.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural and logical substitutions and changes may be made without departing from the scope of this disclosure. Figures are also merely representational and may not be drawn to scale. Similar numerals designate similar elements among the several figures. Certain proportions thereof may be exaggerated, while others may be minimized. Accordingly, the specification and drawings are to be regarded in an illustrative rather than a restrictive sense. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Therefore, it is intended that the disclosure not be limited to the particular embodiment(s) disclosed.

What is claimed is:

1. A drip-preventing beverage sleeve and a paper beverage cup, comprising:

a sleeve body sized to receive a sidewall of a paper beverage cup;

a rolled-lip seam of said paper beverage cup;

an inner surface and an outer surface of the sleeve body;

an absorbent liner adhered to and integrated with the inner surface, forming a sleeve-liner combination;

a top edge of the sleeve-liner combination positioned to align within ⅛ inch of the rolled-lip seam when installed;

wherein the absorbent liner is configured to:

(a) be positioned in close proximity to the rolled-lip seam to intercept fluid drips resulting from gaps between a cup lid and the rolled-lip seam; and (b) wick captured fluid, thereby preventing said drips from contacting external surfaces or the user; the absorbent liner is adhered to substantially the entire inner surface.

2. The cup sleeve of claim 1, wherein the liner is adhered to the inner surface using a non-toxic, food-safe adhesive.

3. The cup sleeve of claim 1, wherein the absorbent liner is made of a cellulose-based absorbent material.

4. The cup sleeve of claim 1, wherein the absorbent liner is not visible when the cup sleeve is on the beverage cup.

5. The cup sleeve of claim 1, wherein the top edge is abutted against the rolled-lip seam of the beverage cup.

6. The sleeve of claim 1, wherein the outer surface can bear a printed design or logo.

7. The cup sleeve of claim 1, wherein the adhered absorbent liner comprises a cellulose-based absorbent material.

* * * * *